US008057022B2

(12) United States Patent
Umeda

(10) Patent No.: US 8,057,022 B2
(45) Date of Patent: Nov. 15, 2011

(54) INKJET PRINTERS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 811 days.

(21) Appl. No.: 12/131,686

(22) Filed: Jun. 2, 2008

(65) Prior Publication Data

US 2008/0297571 A1 Dec. 4, 2008

(30) Foreign Application Priority Data

Jun. 1, 2007 (JP) ..... 2007-146961

(51) Int. Cl.
*B41J 2/175* (2006.01)
*B41J 2/01* (2006.01)

(52) U.S. Cl. ..... 347/85; 347/84; 347/104; 347/2; 347/4

(58) Field of Classification Search ..... None
See application file for complete search history.

(56) References Cited

U.S. PATENT DOCUMENTS 7,712,891 B2 * 5/2010 Ishida et al. ..... 347/104
2005/0151782 A1 7/2005 Ishida et al.

FOREIGN PATENT DOCUMENTS

JP 2005-125670 A 5/2005
JP 2006-035662 A 2/2006

* cited by examiner

*Primary Examiner* — Matthew Luu
*Assistant Examiner* — Erica Lin
(74) *Attorney, Agent, or Firm* — Baker Botts L.L.P.

(57) ABSTRACT

An ink jet printer includes an image forming unit. The image forming unit includes a main tank configured to receive ink via a supply port and to store the ink therein, a subtank configured to receive the ink from the main tank and to store the ink therein, and a recording head configured receive the ink from the subtank and to dispense the ink onto a recording medium to form an image thereon. The printer also includes an image reading unit positioned above the image forming unit. The image reading unit is configured selectively move between a first position in which the image reading unit covers the supply port, and a second position in which the image reading unit is separated from the supply port.

8 Claims, 9 Drawing Sheets

SUPPLY ENABLE STATE (b)

SUPPLY DISABLE STATE (a)

INKJET PRINTERS

CROSS-REFERENCE TO RELATED APPLICATION

The present application claims priority from Japanese Patent Application No. JP-2007-146961, which was filed on Jun. 1, 2007, the disclosure of which is incorporated herein by reference in its entirety.

BACKGROUND OF THE INVENTION

1. Field of the Invention

The present invention relates generally to inkjet printers, and in particular, to inkjet printers comprising an image forming unit and an image reading unit.

2. Description of the Related Art

A known inkjet printer, such as the inkjet printer described in Japanese Unexamined Patent Application Publication No. 2006-35662, includes an image forming unit and an image reading unit positioned above the image forming unit.

SUMMARY OF THE INVENTION

A technical advantage of the present invention is that a size of the inkjet printer may be reduced. Another technical advantage of the present invention is that foreign substances, such as dust, adjacent to a supply port of a main tank may not mix with ink in the main tank during ink supply.

According to an embodiment of the present invention, an inkjet printer comprises an image forming unit. The image forming unit comprises at least one main tank configured to receive ink via a supply port and to store the ink therein, at least one subtank configured to receive the ink from the at least one main tank and to store the ink therein, and a recording head configured receive the ink from the at least one subtank and to dispense the ink onto a recording medium to form an image thereon. The printer also comprises an image reading unit positioned above the image forming unit. The image reading unit is configured selectively move between a first position in which the image reading unit covers the supply port, and a second position in which the image reading unit is separated from the supply port.

According to another embodiment of the present invention, an inkjet printer comprises an image forming unit. The image forming unit comprises at least one main tank configured to receive ink via a supply port and to store the ink therein, at least one subtank configured to receive the ink from the at least one main tank and to store the ink therein, and a recording head configured receive the ink from the at least one subtank and to dispense the ink onto a recording medium to form an image thereon. The printer also comprises at least one cover member configured to move between a first position in which the at least one cover member covers the supply port, and a second position in which the at least one cover member does not cover the supply port. Moreover, the printer comprises an image reading unit positioned above the image forming unit. The image reading unit is configured selectively move between a closed position and an opened position. Specifically, when the image reading unit is in the closed position the at least one cover member is in the first position, and when the image reading unit is in the opened position and an amount of ink within the at least one main tank is less than a predetermined amount of ink the at least one cover member is in the second position. In another embodiment of the present invention, when the image reading unit is in the opened position and the amount of ink within the at least one main tank is greater than or equal to the predetermined amount of ink the at least one cover member is in the first position.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-9, like numerals being used for like corresponding portions in the various drawings.

Figure 1:
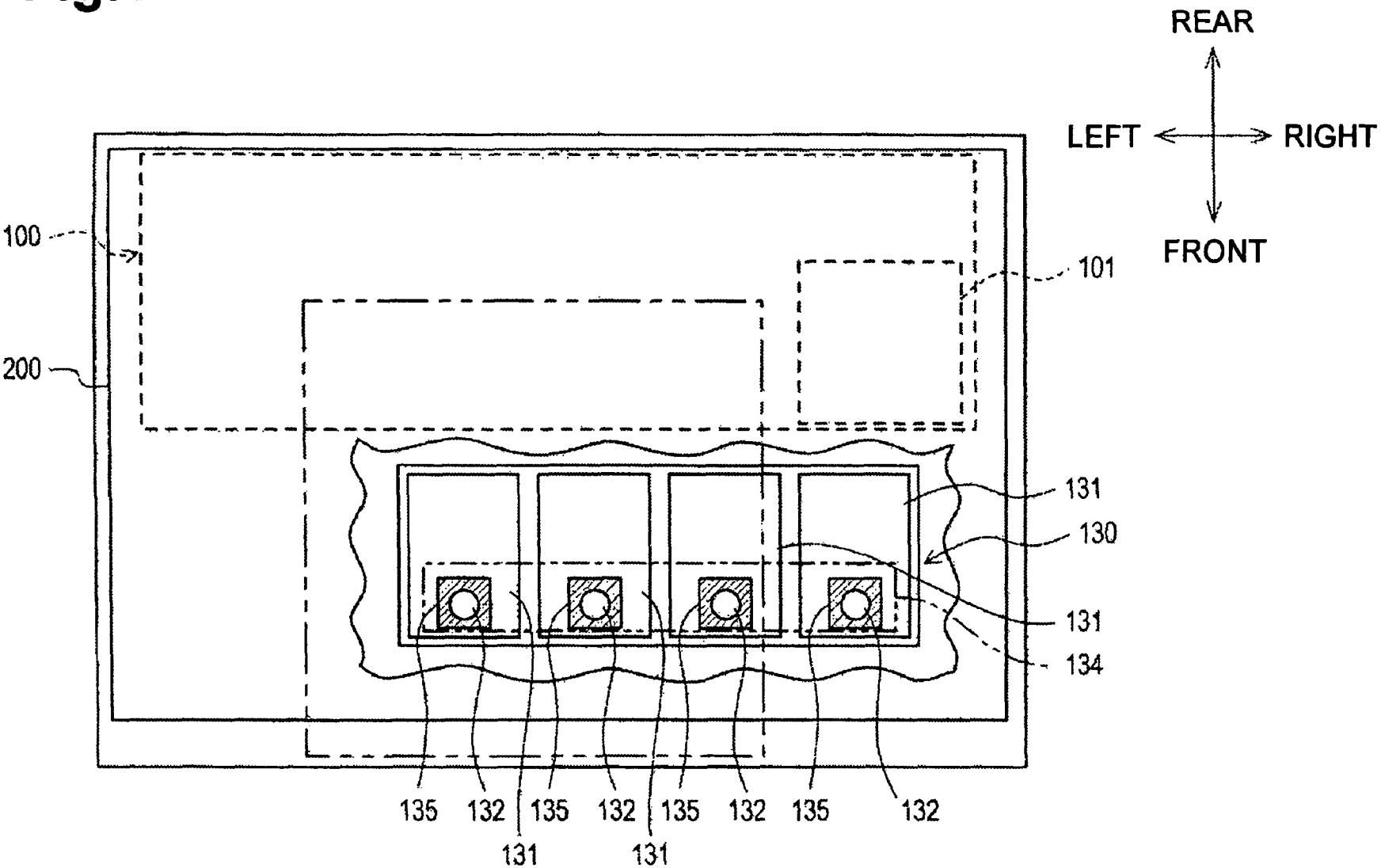
FIG. 1 is a top view of an inkjet printer, according to an embodiment of the present invention.

Referring to FIG. 1, an inkjet printer according to an embodiment of the present invention is depicted. The inkjet printer may comprise an image forming unit 100, and an image reading unit 200, e.g., a scanner, such as a flat bed type scanner. The image forming unit 100 is configured to form an image on a recording medium, such as a recording sheet, by dispensing ink droplets onto the recording medium. The image forming unit 100 is configured to dispense ink droplets of at least one color, e.g., four colors, such as cyan, magenta, yellow, and black, onto predetermined portions of the recording medium to form an image thereon.

Figure 2:
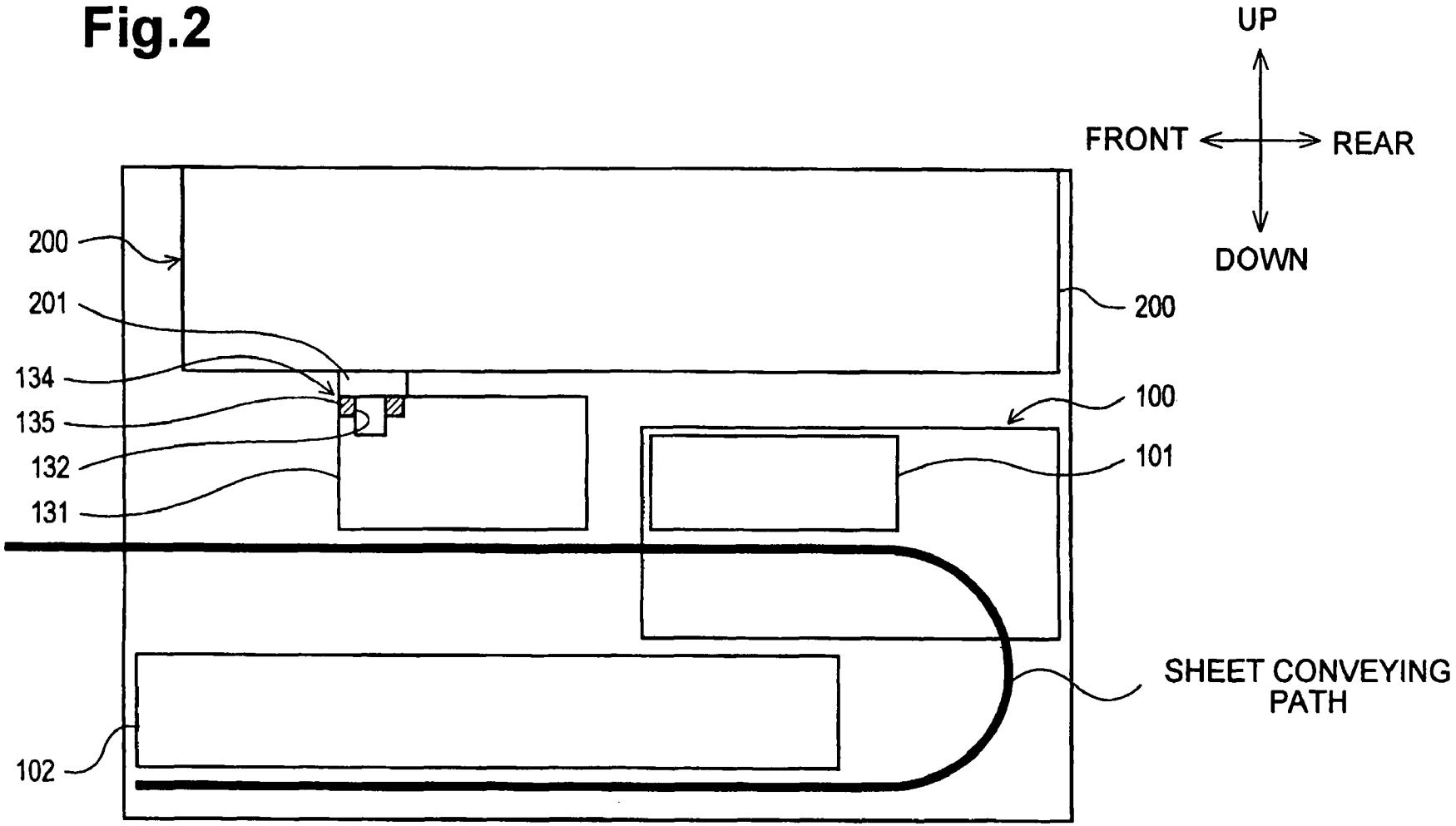
FIG. 2 is a side view of the inkjet printer if FIG. 1 in which an image reading unit is in a closed position.
Figure 3:
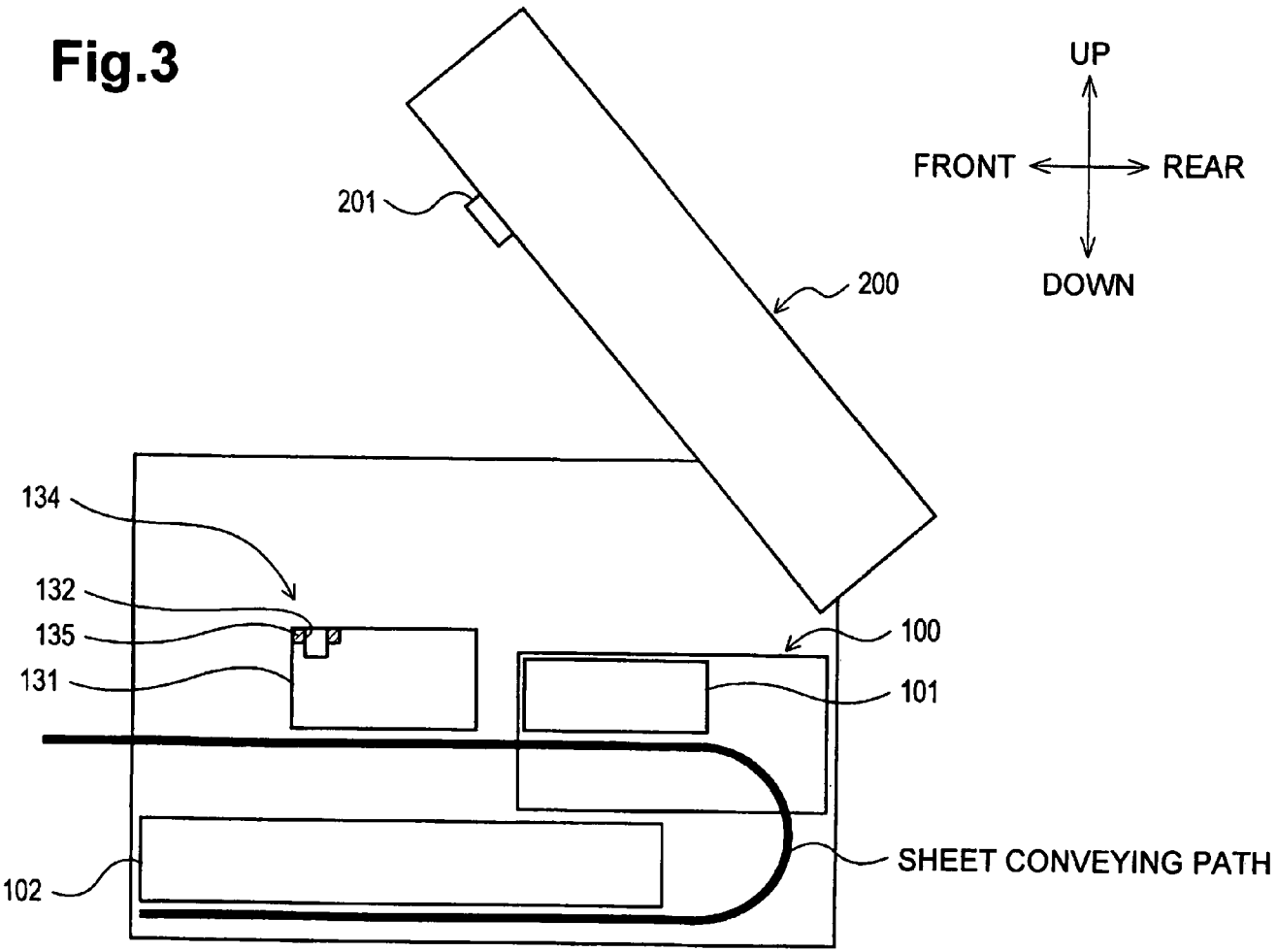
FIG. 3 is a side view of the inkjet printer if FIG. 1 in which the image reading unit is in an opened position.
Figure 4:
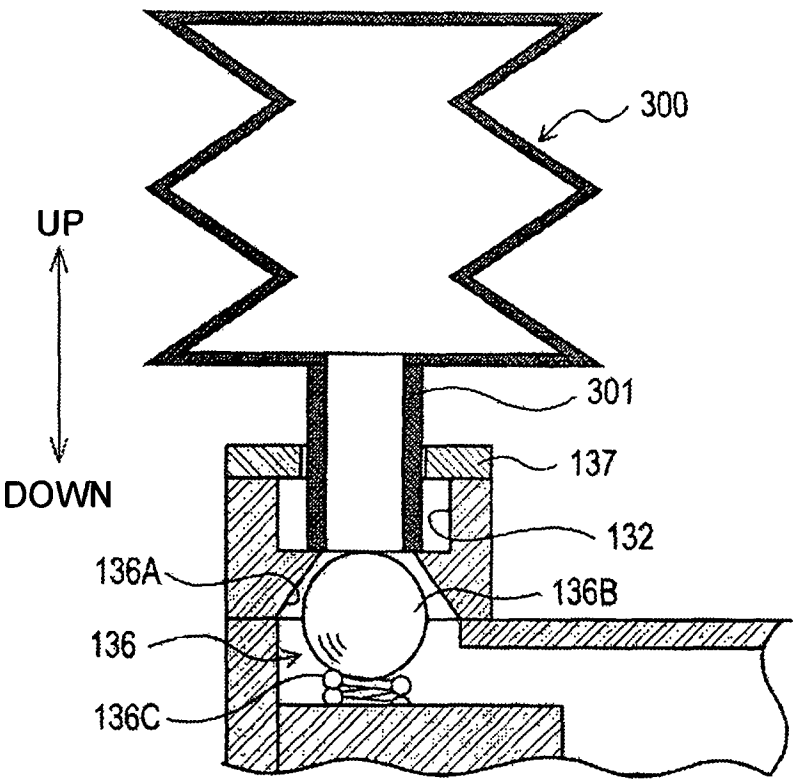
FIGS. 4A and 4B are cross-sectional views of a supply port of the printer of FIG. 1.
Figure 4:
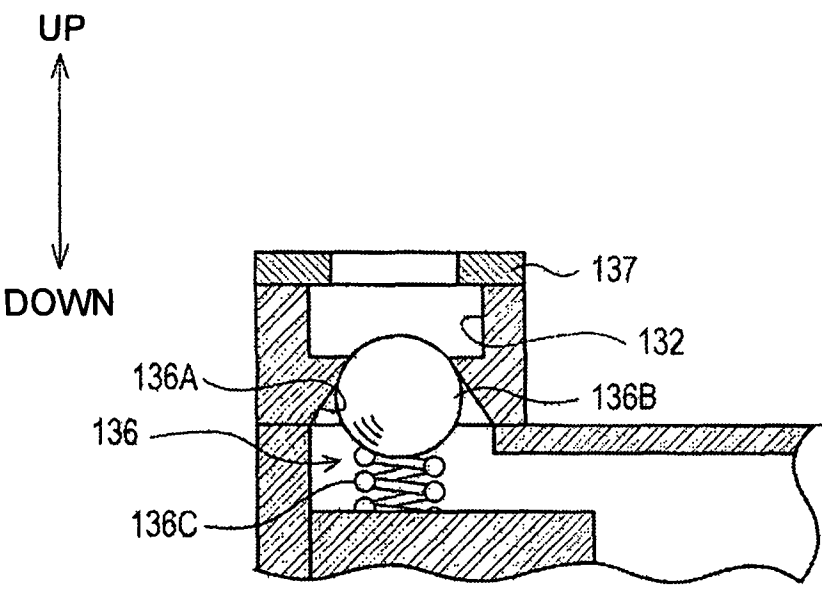

Referring to FIGS. 2 and 3, a recording medium supply tray 102 may be configured to receive at least one recording medium thereon and to supply the recording medium to a recording head unit 101, e.g., by conveying the recording medium along a U-shaped conveying path to the recording head unit 101.

The image reading unit 200 may comprise a reading window formed by a platen comprising a transparent material, such as glass or acrylic, and an image formed on a medium may be read by an image pickup element (not shown), such as a CCD or a CIS, positioned below the platen.

The image reading unit 200 may be positioned above the image forming unit 100. The image reading unit 200 may be positioned in a printer body, e.g., a stationary portion of the inkjet printer comprising, for example, a frame and a housing. The image reading unit 200 may be configured to pivot between a closed position in which an upper side of the image forming unit 100 is covered by the image reading unit 200, and an opened position in which the upper side of the image forming unit 100 is exposed. Alternatively, the image reading unit 200 may be configured to slide relative to the printer body.

The image forming unit 100 may be formed by an inkjet printer engine of a station supply type. More specifically, a subtank 121 and a main tank unit 130 may be connected when ink is supplied to the subtank 121, and may not be connected when ink is not being supplied to the subtank 121, e.g., during image formation.

In operation, when the amount of ink in the subtank 121 is less than or equal to a predetermined amount of ink, the main tank unit 130 and the subtank 121 are connected, and ink is supplied to the subtank 121. When the amount of ink in the subtank is greater than the predetermined amount of ink, the main tank unit 130 and the subtank 121 are not connected.

Figure 5:
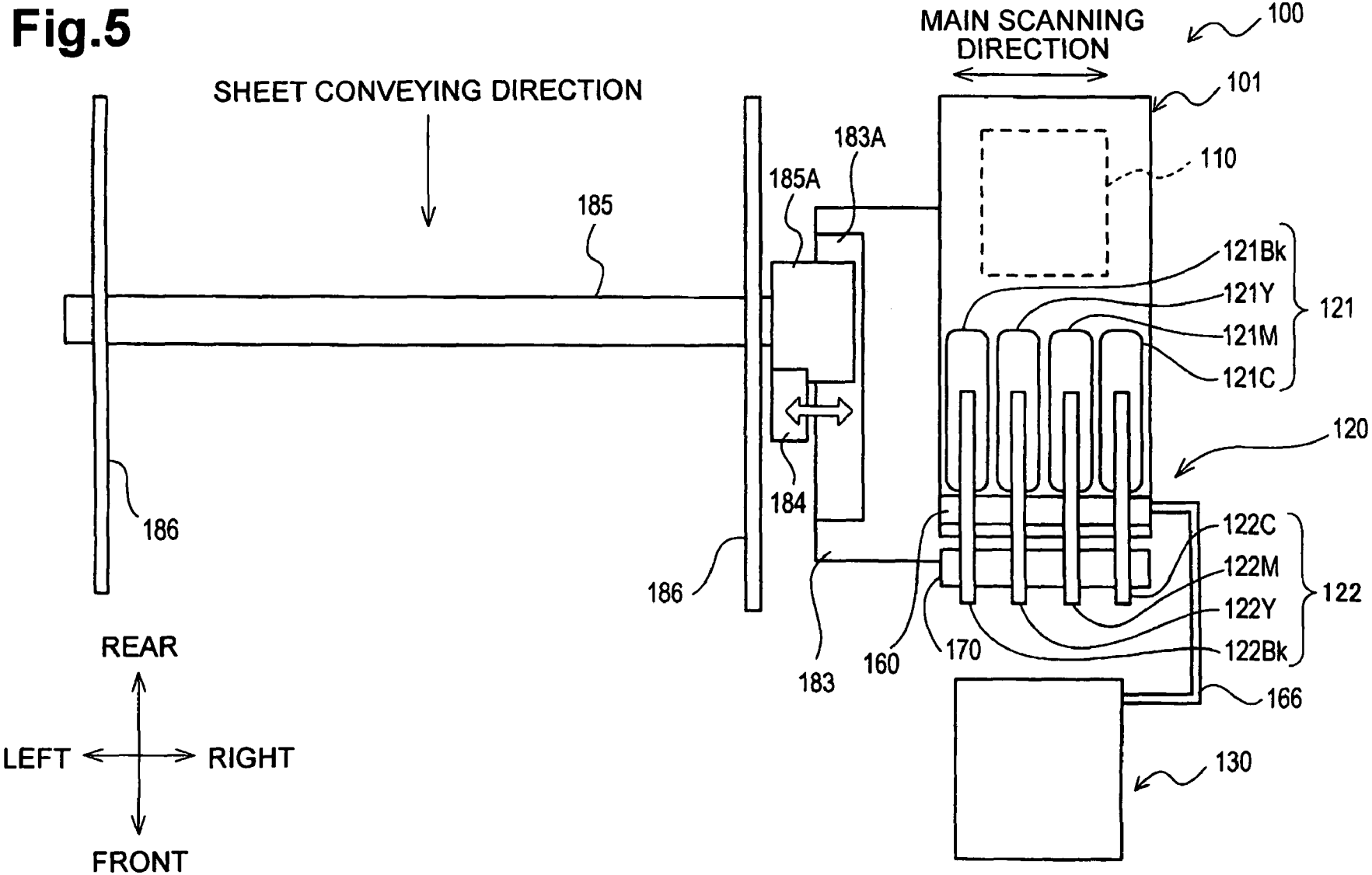
FIG. 5 is a top view of an image forming unit of the printer of FIG. 1.

Referring to FIG. 5, a recording head unit, e.g., a carriage 101, may comprise a recording head 110 configured to dispense ink droplets onto the recording medium, and a subtank unit 120 configured to supply ink to the recording head 110. During image formation, the recording head unit 101 reciprocates in a direction orthogonal to a recording medium conveying direction and parallel to a recording surface of the recording medium, e.g., in the right-left direction in FIG. 5, which is a main scanning direction.

A plurality of nozzles (not shown) configured to dispense ink may be positioned on a surface of the recording head 110 facing a conveyed recording medium. The nozzles may be arranged in lines which are parallel to the recording medium conveying direction.

The subtank unit 120 may comprise a plurality of subtanks 121C, 121M, 121Y, and 121Bk arranged in series in the main scanning direction, and push levers 122C, 122M, 122Y, and 122Bk for applying a force to the subtanks 121C, 121M, 121Y, and 121Bk, respectively. For example, the subtank 121C may store cyan (C) ink therein, the subtank 121M may store magenta (M) ink therein, the subtank 121Y may store yellow (Y) ink therein, and the subtank 121Bk may store black (Bk) ink therein. The subtanks 121C, 121M, 121Y, and 121Bk may be substantially similar except for the color of the ink stored therein, and the push levers 122C, 122M, 122Y, and 122Bk may be substantially similar except that they operate on different subtanks. Therefore, subtanks 121C, 121M, 121Y, and 121Bk generically are referred to as subtanks 121 in the present application, and the push levers 122C, 122M, 122Y, and 122Bk generically are referred to as push levers 122 in this application.

Each subtank 121 may be shaped like a bellows which may elastically expand and contract, e.g., in a direction which is orthogonal to the main scanning direction and the recording medium conveying direction.

Figure 6:
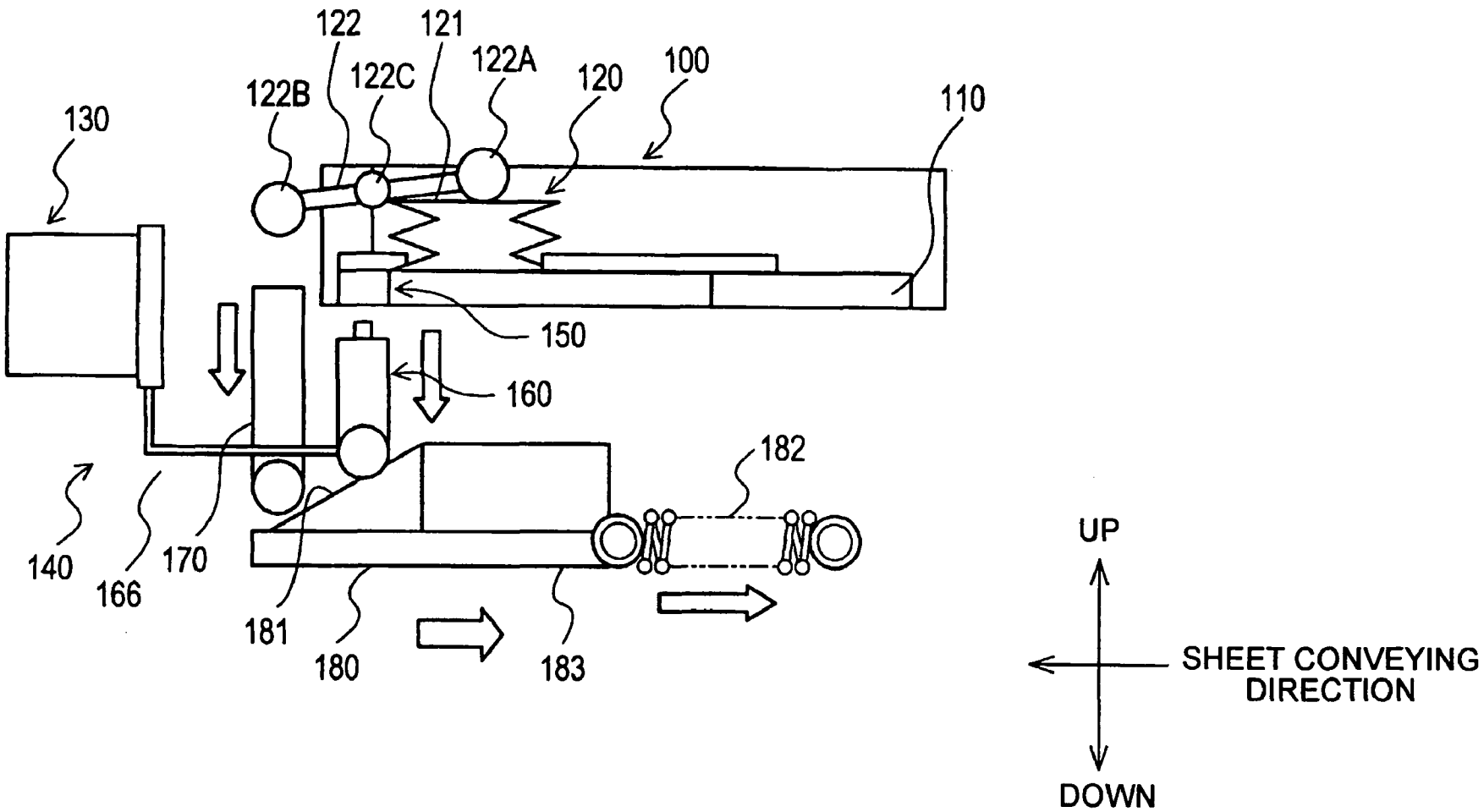
FIG. 6 is a schematic diagram showing an ink supply operation of the inkjet printer of FIG. 1.
Figure 7:
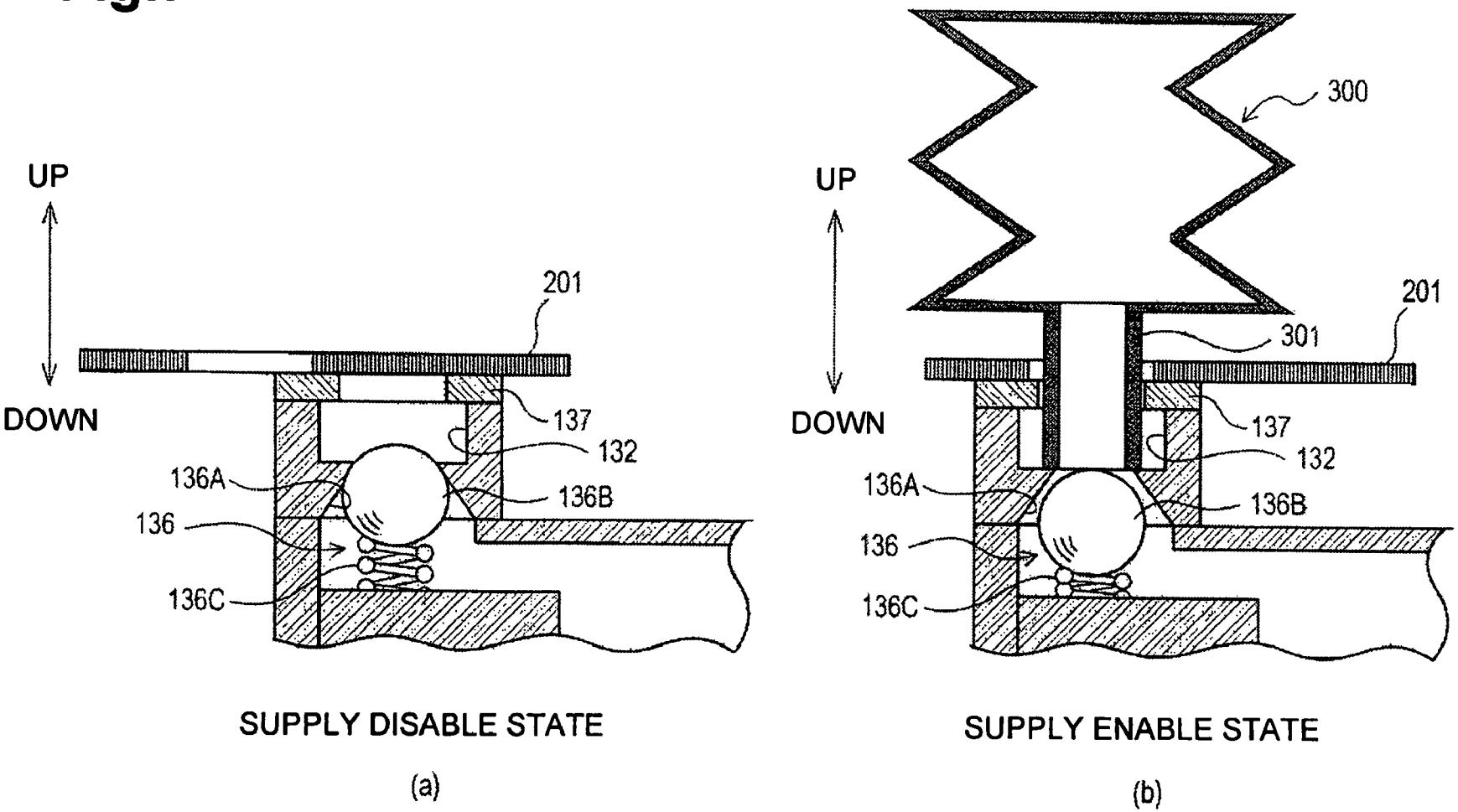
FIGS. 7A and 7B are cross-sectional views of a supply port, according to another embodiment of the present invention.

Referring to FIG. 6, each push lever 122 may be pivotally connected at one longitudinal end 122A to an upper end of the subtank 121, and the other longitudinal end 122B of the push lever 122 may be positioned outside an outer edge of the recording head unit 101. A support portion 122C may be positioned between the longitudinal ends 122A and 122B of the push lever 122, such that the support portion 122C pivotably supports the push lever 122.

An ink supply mechanism 140 may be configured to supply ink from the main tank unit 130 to the subtank 121. The ink supply mechanism 140 may comprise a subtank-side joint valve 150, a main-tank-side joint valve 160, a pushrod 170 for applying a force to the end 122B of the push lever 122, and a slide cam 180 for operating the main-tank-side joint valve 160 and the pushrod 170.

The slide cam 180 may have a cam surface 181 which is in contact with longitudinal ends of the main-tank-side joint valve 160 and the pushrod 170 to move the main-tank-side joint valve 160 and the pushrod 170 in the longitudinal direction.

In order to move the main-tank-side joint valve 160 and the pushrod 170 upward, a driving force from a recording medium dispensing roller 185 moves the slide cam 180 to the left in FIG. 6.

In contrast, in order to move the main-tank-side joint valve 160 and the pushrod 170 downward, an elastic force of a return spring 182 moves the slide cam 180 to the right in FIG. 6 while blocking the transmission of the driving force from the recording medium dispensing roller 185.

The slide cams 180 for the respective subtanks 121 are combined by a base plate 183. Referring to FIG. 5, a rack gear 183A is positioned on a side of the base plate 183 adjacent to the recording medium dispensing roller 185.

A driving force is transmitted from a gear 185A positioned at a longitudinal end of the recording medium dispensing roller 185 to the rack gear 183A (base plate 183) by a pinion gear 184. The pinion gear 184 may be movable between a position in which the pinion gear 184 engages the rack gear 183A, and a position in which the pinion gear 184 is separated from the rack gear 183A. The position of the pinion gear 184 may be switched by an actuator, such as an electromagnetic solenoid (not shown).

The recording medium dispensing roller 185 may be configured to convey a recording medium toward an dispensing port (not shown) after an image is formed on the recording medium. The recording medium may be conveyed between a pair of right and left frames 186 after image formation.

Referring to FIG. 1, the main tank unit 130 may comprise a plurality of main tanks 131 that are filled with ink to be supplied to the subtanks 121. The main tank unit 130 comprising the main tanks 131 may be fixed to the printer body.

Each main tank 131 may comprise a supply port 132 through which ink is supplied. Alternatively, supply port 132 and main tank 131 may be separate elements connected via a tube (not shown). A supply unit 134 may correspond to a portion of the main tank unit 130 enclosed by a double-dot chain line in FIG. 1, i.e., where the supply ports 132 are positioned. Referring to FIGS. 2 and 3, the supply unit 134 may be exposed when the image reading unit 200 is in the opened position, and may be covered when the image reading unit 200 is in the closed position. For example, when the image reading unit 200 is in the closed position, the image reading unit 200 may contact, e.g., sealidly contact, the supply ports 132, and when the image reading unit 200 is in the closed position, the image reading unit 200 may be separated from the supply ports 132 to expose the supply ports 132.

Referring to FIG. 1, an ink absorber 135 may be configured to absorb ink and may be positioned around each supply port 132. The ink absorber 135 may comprise a porous material, e.g., may function as a sponge.

Referring to FIGS. 4A and 4B, a check valve 136 may be configured to selectively open and close the supply port 132. When the check valve 136 closes the supply port 132, the check valve 136 prevents ink in the main tank 131 from flowing out through the supply port 132. In contrast, when the check valve 136 is separated from the supply port 132 to open the supply port 132, ink may flow into the main tank 131 via the supply port 132.

The check valve 136 may comprise any known ball check valve, and may comprise a ball-shaped valve body 136B and a spring 136C. The valve body 136B may be positioned on a side of a valve port 136A adjacent to the inside of the main tank 131, and is configured to selectively open and close the valve port 136A. The spring 136C presses the valve body 136B against the valve port 136A from the inside of the main tank 131.

An ink supply bellows 300 may store ink therein and may be configured to supply ink to the main tank 131. The ink supply bellows may comprise a needle portion 131. In order to supply ink to the main tank 131, a user causes the valve body 136B to open the check valve 136 by inserting the needle portion 301 into the supply port 132, and compresses the ink supply bellows 300, such that the ink supply bellows 300 supplies ink into the main tank 131.

Referring to FIGS. 2 and 3, the image reading unit 200 may comprise a lid member 201 positioned at a portion of the image reading unit 200 facing the supply unit 134. The lid member 201 may cover the supply port 132 when the image reading unit 200 is in the closed position. Moreover, referring to FIGS. 4A and 4B, a packing member 137 may be positioned at a portion of the supply port 132 facing the lid member 201, and may be configured to seal the space between the supply port 132 and the lid member 201 when the image reading unit 200 is in the closed position.

In the above-described embodiments of the present invention, the supply unit 134 is exposed when the image reading unit 200 is in the opened position, and is not exposed when the image reading unit 200 is in the closed position. Therefore, during ink supply, ink is directly supplied from the supply port 132, not via a cartridge, when the image reading unit 200 is in the opened position and the supply unit 134 is exposed. Consequently, there is not a need to provide a mechanism for removably fixing the cartridge to the cartridge holder, which reduces the size of the image forming unit 100. Moreover, image reading unit 200 comprises the lid member 201, such that the supply port 132 may be protected by the lid member 201 using a non-complicated structure, and it is possible to prevent a foreign substance, such as dust, adjacent to the supply port 132 from mixing with ink in the main tank 131 during ink supply. In addition, because the check valve 136 is positioned at the supply port 132, ink may not leak from the main tank 131, and because the ink absorber 135 is positioned around the supply port 132, the ink absorber may absorb ink scattered around the supply port 132 during ink supply. Therefore, it is possible to prevent the peripheral portion of the supply port 132 from being soiled with scattering ink, or prevent scattering ink from being mixed with another color ink during the next ink supply operation.

Referring to FIG. 7A-9, another embodiment of the present invention is depicted. This embodiment of the present invention may be similar to the above-described embodiments of the present invention. Therefore, only those differences between this embodiment of the present invention and the above-described embodiments of the present invention are discussed with respect to this embodiment of the present invention.

Figure 8:
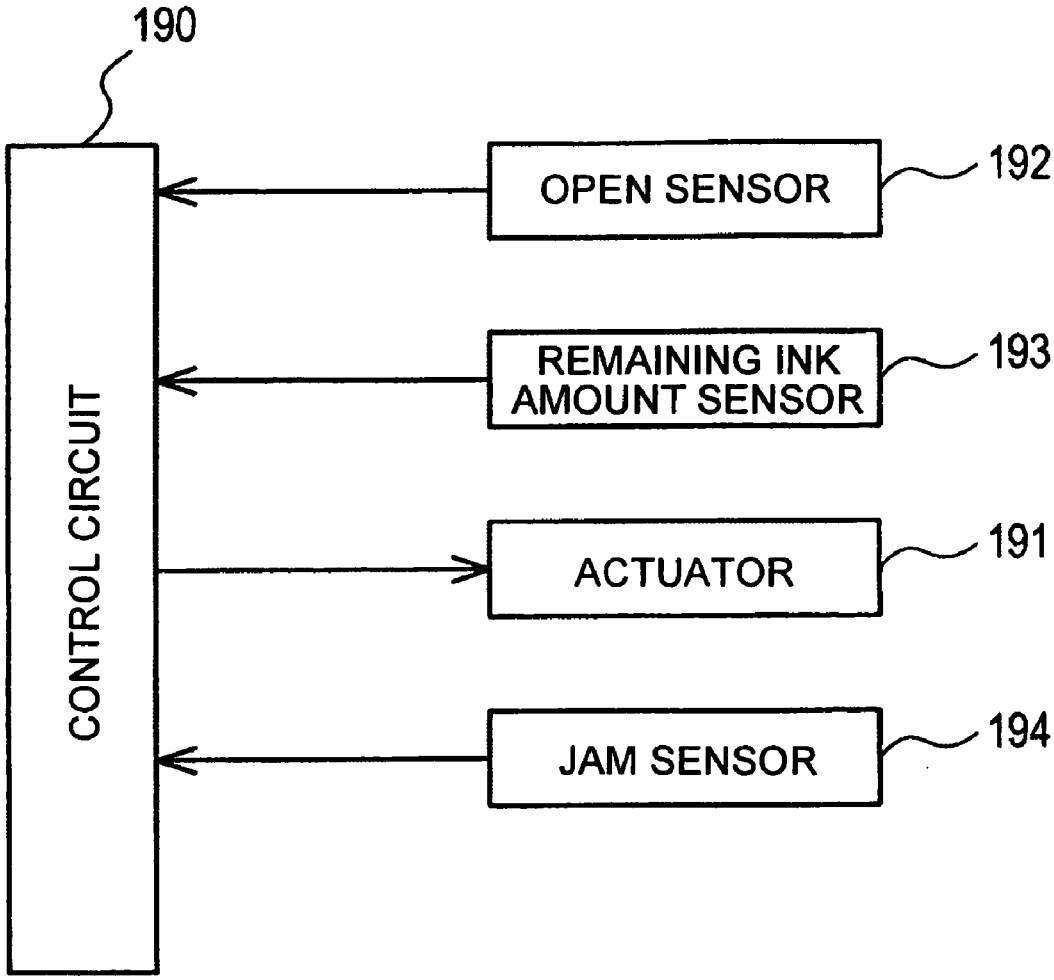
FIG. 8 is a block diagram of a control unit for a lid member.

Referring to FIGS. 7A, 7B, and 8, in this embodiment, the lid member 201 may be positioned at the supply unit 134, and may be electrically displaced by an actuator 191, such as an electric motor. The lid member 201 may be configured to move between a position in which the lid member 201 covers the supply port 132, and a position in which the supply port 132 is exposed via an opening (not numbered, but shown in FIGS. 7A and 7B) formed through the lid member 201. In an embodiment, a separate lid member 201 and a separate actuator 191 may be provided for each supply port 132.

FIG. 8, a control circuit 190 for controlling the operation of the actuator 191 receives detection signals from an open sensor 192, a remaining ink amount sensor 193, and a jam sensor 194. The open sensor 192 detects at which of the close and opened positions the image reading unit 200 is placed. The remaining ink amount sensor 193 detects the amount of ink remaining in each main tank 131. The jam sensor 194 detects whether a paper jam has occurred in a recording medium conveying path.

Referring to FIGS. 7A, 7B, and 8, in this embodiment, the lid member 201 may be positioned at the supply unit 134, and may be electrically displaced by an actuator 191, such as an electric motor. The lid member 201 may be configured to move between a position in which the lid member 201 covers the supply port 132, and a position in which the supply port 132 is exposed via an opening (not numbered, but shown in FIGS. 7A and 7B) formed through the lid member 201. In an embodiment, a separate lid member 201 and a separate actuator 191 may be provided for each supply port 132, such that each of the lid members 201 may move independently.

Referring to FIG. 8, a control circuit 190 may be configured to control the operation of the actuator 191. Specifically, the control circuit 190 receives detection signals from an open sensor 192, a remaining ink amount sensor 193, and a jam sensor 194. The open sensor 192 detects whether the image reading unit is in the opened position or the closed position, the remaining ink amount sensor 193 detects the amount of ink remaining in each of the main tanks 131, and the jam sensor 194 detects whether a paper jam has occurred in a sheet conveying path.

Similarly, while only one remaining ink amount sensor 193 is shown in FIG. 8, in actuality, a number of remaining ink amount sensors 193 corresponding to the number of main tanks 131 are positioned. Therefore, the control circuit 190 can separately detect the amounts of remaining ink in the main tanks 131.

When the open sensor 192 detects that the image reading unit 200 is in the opened position and the remaining ink amount sensor 193 detects that the amount of ink remaining in any main tank 131 is less than or equal to a predetermined amount of ink, the control circuit 190 starts the actuator 191 to move the lid member 201 of the detected main tank 131, such that the corresponding supply port 132 is exposed.

When the open sensor 192 detects that the image reading unit 200 is in the closed position, the control circuit 190 operates the actuator 191, such that all the supply ports 132 are covered by their corresponding lid member 201.

Figure 9:
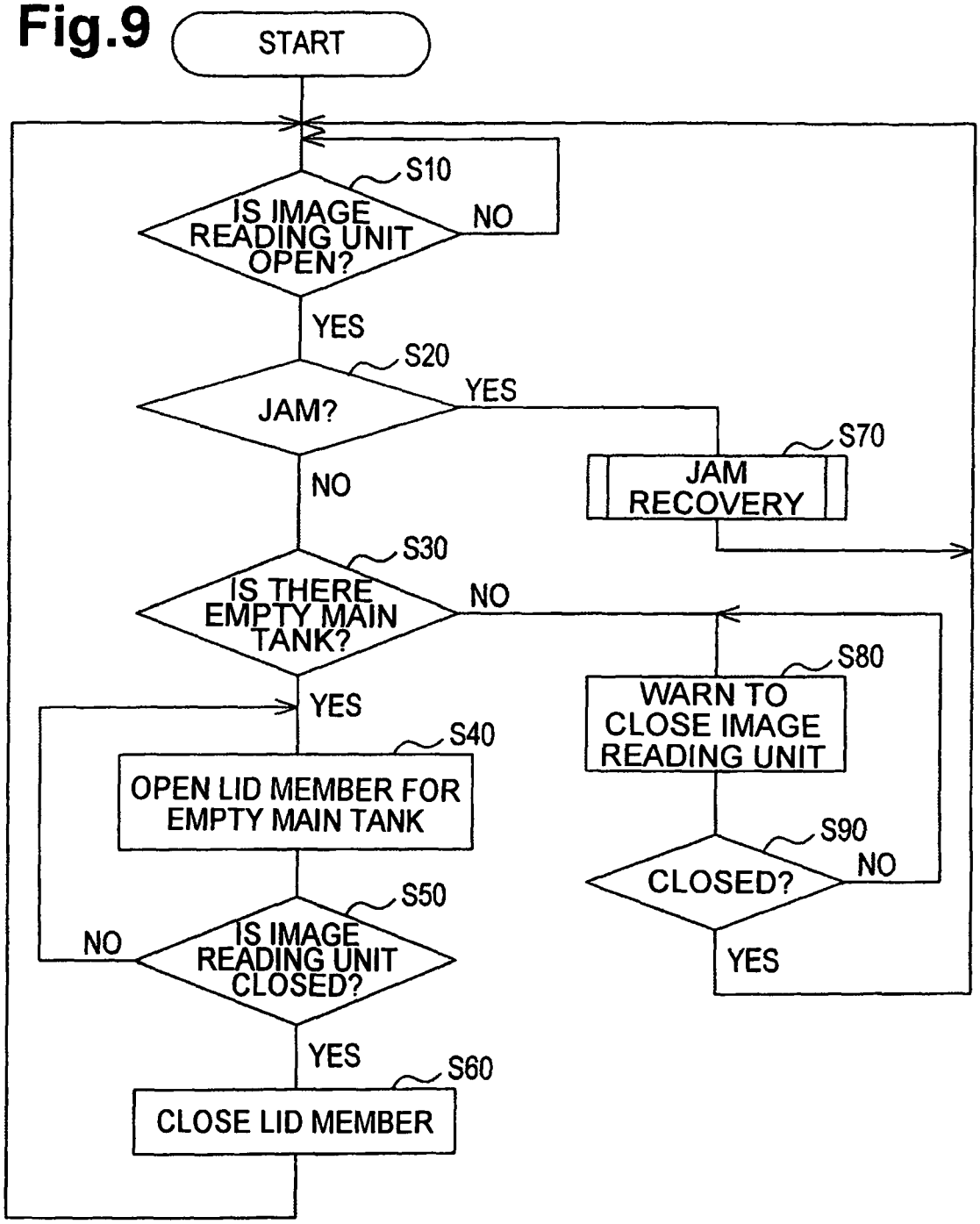
FIG. 9 is a flowchart of a procedure for controlling the operation of the lid member.

Referring to FIG. 9, a control procedure begins when a power switch (not shown) of the inkjet printer is turned on, and ends when the power switch is turned off. When the control procedure begins, it first is determined whether the image reading unit 200 is in the opened position, e.g., based on a detection signal from the open sensor 192 (Step S10). When it is determined that the image reading unit 200 is in the opened position (Step S10: YES), it is determined whether a paper jam has occurred in the recording medium conveying path, e.g., based on a detection signal from the jam sensor 194 (Step S20).

When it is determined that a paper jam has not occurred (Step S20: NO), it is determined whether the amount of ink remaining in the main tank 131 is less than or equal to the predetermined amount, e.g., based on a detection signal from the remaining ink amount sensor 193 (Step S30). When it is determined that the amount of remaining ink is less than or equal to the predetermined amount (Step S30: YES), the lid member 201 is opened, such that the supply port 132 corresponding to the detected main tank 131 is exposed (Step S40).

Subsequently, it is determined whether the image reading unit 200 is in the closed position, e.g., based on a detection signal from the open sensor 192 (Step S50). When it is determined that the image reading unit 200 is not in the closed position (Step S50: NO), the lid member 201 remains in the opened position. In contrast, when it is determined that the image reading unit 200 is in the closed position (Step 50: YES), the lid member 201 is closed to cover the supply port 132 (Step S60).

When it is determined in Step S20 that a paper jam has occurred (Step S20: YES), a predetermined jam recovery operation is performed (Step S70), and Step S10 again is performed. When it is determined in Step S30 that the amount of ink remaining in the main tank 131 is more than the predetermined amount of ink (Step S30: NO), the user is advised to close the image reading unit 200 (Steps S80, S90). In contrast, when it is determined that the image reading unit 200 is in the closed position (Step S90: YES), Step S10 again is performed.

In this embodiment of the present invention, the supply port 132 automatically may be covered by the lid member 201 when the image reading unit 200 is in the closed position. Therefore, the supply port 132 may be protected by the lid member 201, and a foreign substance, such as dust, is prevented from adhering adjacent to the supply port 132. Consequently, it is possible to prevent a foreign substance, such as dust, adjacent to the supply port 132 from entering the main tank 131 with the ink during the ink supply operation.

The lid member 201 may be configured to automatically move depending on whether the image reading unit 200 is in the closed position or the opened position. Therefore, the user does not need to manually move the lid member 201, and the ink supply operation is not complicated.

The supply port 132 is exposed by opening the lid member 201 when it is determined that the image reading unit 200 is in the opened position and that the amount of ink remaining in the main tank 131 is less than or equal to the predetermined amount. Consequently, the supply port 132 is covered by the lid member 201 except when the ink is supplied to the main tank 131. Therefore, the supply port 132 reliably may be protected.

Moreover, because the lid members 201 may operate independently, the supply port 132 corresponding to the main tank 131 containing an amount of ink less than or equal to the predetermined amount may be exposed without exposing the other supply ports 132.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An inkjet printer comprising:

an image forming unit comprising: at least one main tank configured to receive ink via a supply port and to store the ink therein; at least one subtank configured to receive the ink from the at least one main tank and to store the ink therein; and a recording head configured to receive the ink from the at least one subtank and to dispense the ink onto a recording medium to form an image thereon; and an image reading unit positioned above the image forming unit, wherein the image reading unit is configured to selectively move between a first position in which the image reading unit covers the supply port, and a second position in which the image reading unit is separated from the supply port.

2. The inkjet printer of claim 1, wherein the at least one main tank comprises the supply port.

3. The inkjet printer of claim 1, further comprising a tube, wherein the supply port is connected to the at least one main tank via the tube.

4. The inkjet printer of claim 1, wherein the image reading unit comprises a lid member configured to cover the supply port when the image reading unit is in the first position, and to be separated from the supply port when the image reading unit is in the second position.

5. The inkjet printer of claim 1, further comprising a check valve configured to selectively open and close the supply port.

6. The inkjet printer of claim 5, wherein the check valve comprises:

a ball-shaped valve body; and a spring configured to apply a biasing force to the ball-shaped valve body to urge the ball-shaped valve body in a first direction toward the supply port, wherein when the ball-shaped valve body receives a force in a second direction opposite the first direction, which is greater than the biasing force, the ball-shaped valve body moves in the second direction to open the supply port.

7. The inkjet printer of claim 1, further comprising an ink absorber positioned adjacent to the supply port, wherein the ink absorber is configured to absorb ink.

8. The inkjet printer of claim 1, wherein the at least one main tank is fixed to the printer body.

* * * * *